US005375678A

United States Patent [19]

Bell

[11] Patent Number: 5,375,678

[45] Date of Patent: Dec. 27, 1994

[54] DEVICE FOR PROVIDING A TEMPORARY ANCHOR CONNECTING POINT ON SCAFFOLDING

[76] Inventor: Michael Bell, 1705 Triumphe Way, Warrington, Pa. 18976

[21] Appl. No.: 246,021

[22] Filed: May 19, 1994

[51] Int. Cl.[5] ..... A62B 35/00

[52] U.S. Cl. ..... 182/3; 248/499

[58] Field of Search ..... 182/3, 129; 248/499, 248/507, 508

[56] References Cited

U.S. PATENT DOCUMENTS 5,064,671 4/1991 Mallard ..... 182/3

FOREIGN PATENT DOCUMENTS 271254 1/1951 Switzerland ..... 182/3

*Primary Examiner*—Alvin C. Chin-Shue

*Attorney, Agent, or Firm*—Caesar, Rivise, Bernstein, Cohen & Pokotilow, Ltd.

[57] ABSTRACT

A connector device for releasable securement to a post of scaffolding on which a worker wearing a safety restraint member, e.g., safety belt and associated lanyard, will be disposed. The post terminates at a free upper end. The connector device basically comprises a hollow cup-shaped member formed of any suitable flexible material, e.g., a fabric of nylon or polyester, having a top portion and a downwardly extending peripheral skirt portion. The hollow interior is arranged to receive the top free end of the scaffold post therein. A reinforcing patch is disposed at the top of the hollow interior to abut the top free end of the scaffold post when it is located within the hollow interior of the connecting device. A ring, e.g., of metal, is pivotally secured to the outside of the downwardly depending skirt and is arranged to have the safety device, e.g., the lanyard, releasably secured thereto when the cup-shaped connector device is mounted on the scaffold post.

5 Claims, 4 Drawing Sheets

DEVICE FOR PROVIDING A TEMPORARY ANCHOR CONNECTING POINT ON SCAFFOLDING

BACKGROUND OF THE INVENTION

This invention relates generally to safety devices and more particularly, to a device for temporary use on scaffolding to releasably connect a worker to the device to prevent the worker from falling.

Due to the enactment of various safety laws, persons working at elevated positions, e.g., on scaffolding, etc., are required to be protected against falls. One common approach to achieve that end is the use of a safety belt which is worn on the worker's waist. The belt includes a D-ring or some other metal loop fixedly mounted on the belt in the center of the portion located at the worker's back. The D-ring is arranged to be "tied off" (connected), via a lanyard, to a fixed supporting member or anchor point. The anchor point may be any fixed portion of the scaffolding which is strong enough to support the worker's weight. The securement of the lanyard to the anchor point is typically accomplished by wrapping the lanyard at least once about a horizontally extending portion of the scaffolding. Thus, once the worker is tied off should he/she fall off of the structure he/she will be prevented from falling to the ground. While this technique of preventing falls is generally suitable for its intended purposes it never the less suffers from some drawbacks. For example, by wrapping the lanyard at least once about the anchor point the already relatively short standard lanyard (e.g., typically six feet in length) is substantially reduced, thereby severely restricting the worker's mobility. Moreover, if the lanyard is wrapped about a vertical portion of the scaffolding and is not held at the point at which it is wrapped about the member, it will likely slide down the member to the lowest point that it can. In so doing the worker may be exposed to a drop in excess of six feet, thereby violating OSHA regulations, before the lanyard becomes taut to preclude further droppage.

In my copending U.S. patent application Ser. No. 08/129,536, filed on Sep. 30, 1993, entitled Connector Assembly For Use On Scaffolding To Protect A Worker From Falling, whose disclosure is incorporated by reference herein there is disclosed and claimed a connector assembly which overcomes many of the disadvantages of the prior art. That connector assembly is arranged for releasable securement to a portion of scaffolding on which a worker wearing a safety restraint member, e.g., a safety belt and associated lanyard, will be disposed. The portion of the scaffolding comprises a cylindrical section having a pair of collars disposed on it. Each of the collars defines a channel between it and the cylindrical section.

The connector assembly basically comprises an insert, first and second connector members, a strap member, and a reinforcing member. The strap member is in the form of an elongated flexible member having a top and bottom surface and pair of ends, with each end being in the form of a loop. The reinforcing means comprises a pad of a wear resistant material secured to one of the top or bottom surfaces of the strap. The insert has a pair of projections, each of which is arranged to be located within a respective one of the channels between the collars and the cylindrical section of the scaffolding to releasably secure the insert in place with respect to the scaffolding. The first connector member has a slot therein and is pivotally connected to the insert. The second connector member also has a slot therein and a hole for releasably securing the safety restraint thereto. One of the loops of the strap extends through the slot in the first connector, and the other of the loops extends through the slot in the second connector, thereby fixedly securing the first and second connectors to the ends of the strap.

While the connector assembly of my aforementioned patent is suitable for its intended purposes it never the less still leaves something to be desired from the standpoint of wide applicability since it requires that the scaffolding include slidable collars to which the connector assembly is releasably secured.

OBJECTS OF THE INVENTION

Accordingly, it is a general object of this invention to provide a device for releasable securement to scaffolding or some other elevated structure which overcomes the disadvantages of the prior art.

It is another object of this invention to provide a connector for releasable securement to scaffolding which is effective to prevent a worker connected thereto from falling.

It still another object of this invention to provide a connector for releasable securement to scaffolding which is easy to use.

It is yet another object of this invention to provide a connector for releasable securement to scaffolding which is simple in construction.

SUMMARY OF THE INVENTION

These and other objects of this invention are achieved by providing a device for releasable securement to an upwardly extending cylindrical portion, e.g., a vertical post, of a scaffold on which a worker wearing a safety restraint member, e.g., a safety belt having a lanyard secured thereto, will be disposed. The post terminates in a free, top end.

The device basically comprises a hollow cup-shaped connector member which has a ring secured thereto. The cup-shaped connector member is formed of a flexible material and has a top portion including an inner surface and a downwardly depending skirt portion to form a hollow interior. The device is arranged to be used on the scaffold by inserting the free end of the upwardly extending section of the scaffold within the hollow interior of the cup-shaped connector member.

In accordance with a preferred aspect of the invention the inner surface of the top portion of the cup-shaped member is formed of a reinforcing material for engagement with the free end of the upwardly extending cylindrical portion of the scaffold when that portion of the scaffold is disposed within the hollow interior of the cup-shaped connector member to prevent erosion of the material forming the cup-shaped member.

When the cup-shaped member is in place on the upwardly extending portion of the scaffold the downwardly depending skirt of that member is disposed adjacent the outer surface of the portion of the scaffold contiguous with the top free end thereof. The downwardly depending skirt portion includes a bottom marginal edge portion extending about the periphery of the portion of the scaffold disposed within the cup-shaped member.

The ring of the device is pivotally secured to the bottom marginal edge portion of the cup-shaped member and is arranged to have the safety restraint member, e.g., the lanyard, releasably secured thereto when the device is in place on the scaffold to thereby prevent the working from falling off of the scaffold.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
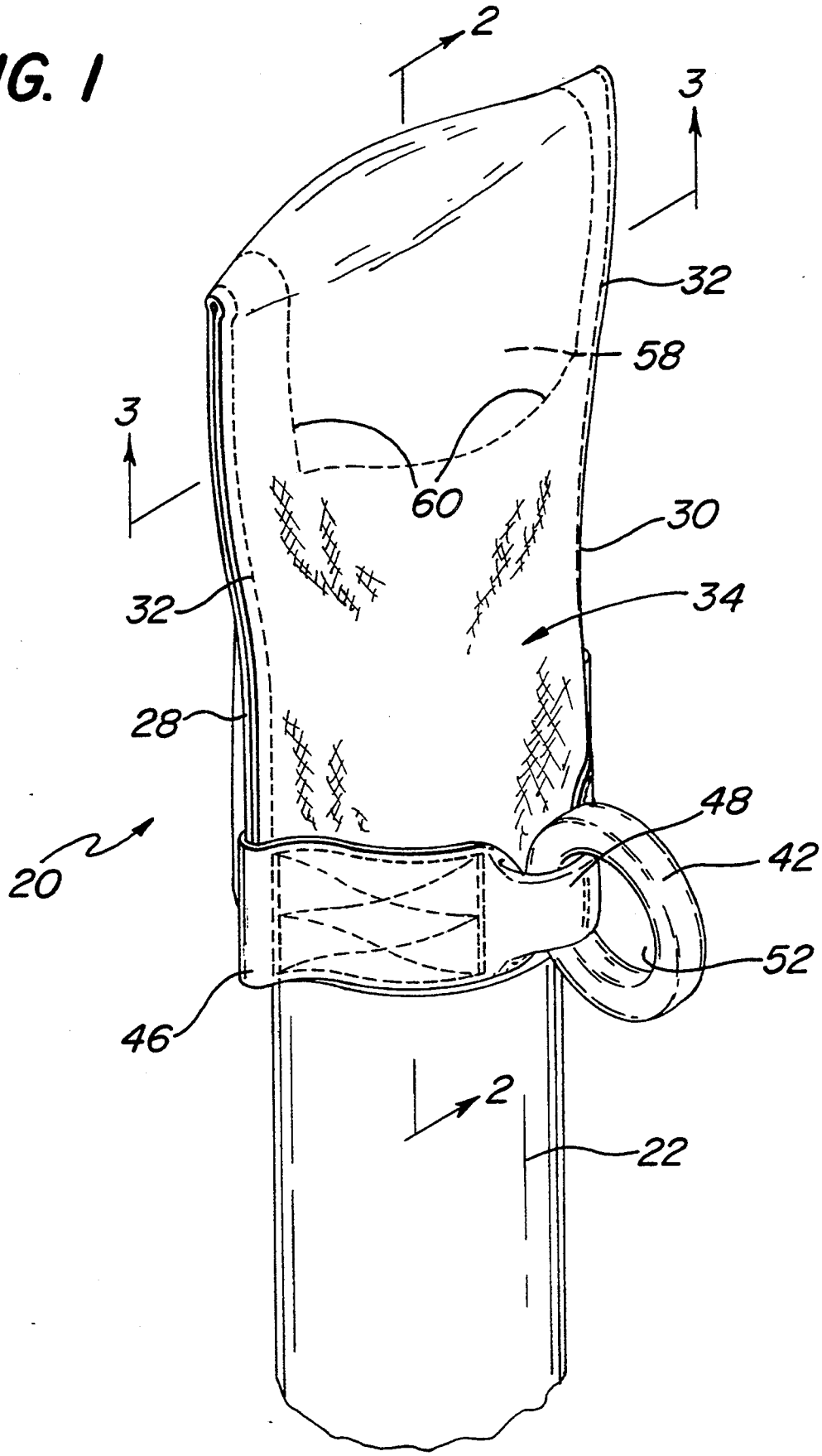
FIG. 1 is an isometric view of one embodiment of a device constructed in accordance with this invention shown mounted on an upwardly extending post of a conventional scaffold.
Figure 4:
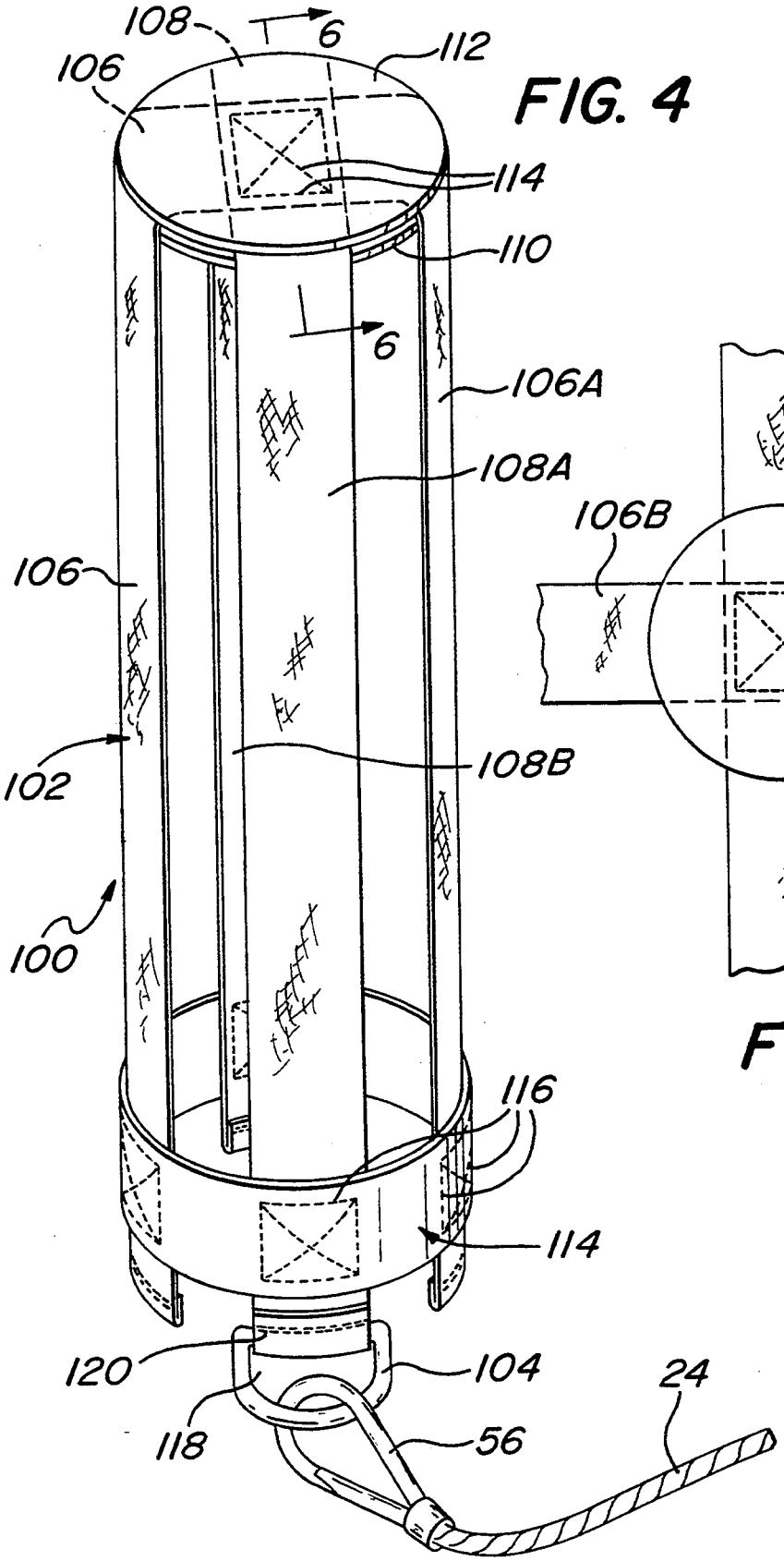
FIG. 4 is an isometric view of a second embodiment of a device constructed in accordance with this invention shown mounted on an upwardly extending post of a conventional scaffold.

Referring now to various figures of the drawing where like reference numerals refer to like parts there is shown at 20 and 100 in FIGS. 1 and 4, respectively, a two embodiments of a connector device constructed in accordance with this invention. Each embodiment is arranged for releasable securement to a portion 22 (FIGS. 1, 2 and 6) of a conventional scaffold so that a worker (not shown) wearing a conventional safety belt or a harness (not shown) having a conventional lanyard 24 (FIG. 4) secured thereto can be secured to the device to prevent the worker from falling off of the scaffold. In accordance with a preferred use of this invention, the portion 22 of the scaffold to which the connector 20 is releasably secured comprises any uprightly extending standard or post having a free end 26. The free end of the post may be planar, as shown, or of any other conventional shape, e.g., rounded. Moreover, the free end 26 may be bare, as shown, or capped with some cap member (not shown).

As will be described later each device 20 and 100 is a generally cup-shaped member having a hollow interior for receipt of the top free end 26 of a scaffold post 22 therein to releasably mount the device on the scaffold post so that it cannot accidently slip thereoff. Moreover, each device includes connector means to which the worker connects his/her lanyard when the device is in place on the scaffold post. In accordance with one preferred use of this invention plural devices 20 will be located on adjacent scaffold posts 22 so that the worker can move from location to location on the scaffold and connect himself/herself to the closest device to protect him/her from a fall, as will be described later.

Figure 2:
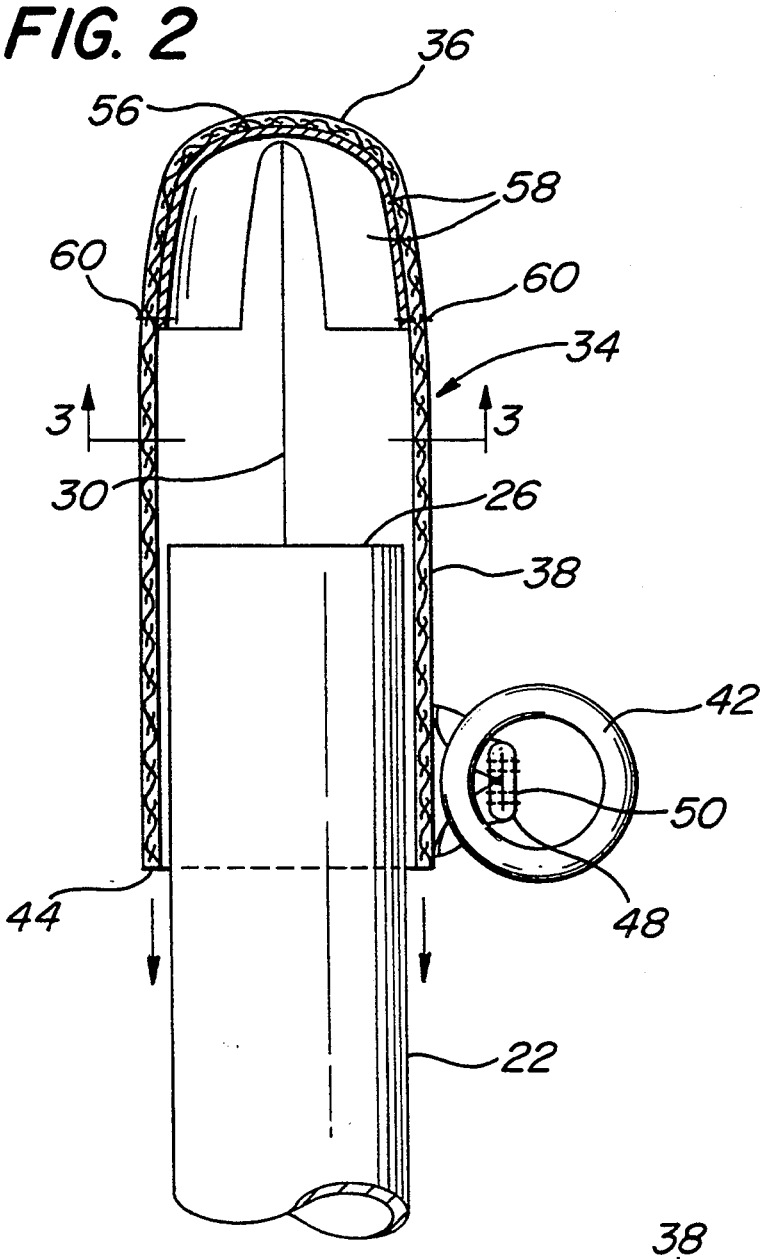
FIG. 2 is a reduced side elevational view showing the device of FIG. 1 in the process of being mounted on the scaffold post.
Figure 3:
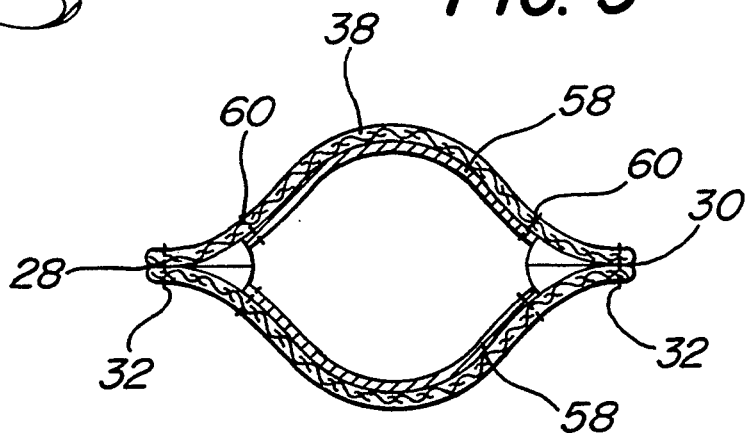
FIG. 3 is a slightly enlarged sectional view taken along line 3—3 of FIG. 2.

As can be seen clearly in FIGS. 1–3 the device 20 is formed of a web of a flexible, yet strong and lightweight fabric, e.g., nylon or polyester. The web may be a single layer or ply or multiple layers or plies of the fabric. In any case the web is folded in half and stitched along its marginal edges 28 and 30 by plural stitch lines 32 to form a generally cup-shaped member 34 having a top wall portion 36 (FIG. 2) and a downwardly depending sidewall or skirt portion 38. The hollow interior of the cup-shaped member is designated by the reference number 40 and is arranged to receive the top free end of the scaffold post 22 therein to releasably mount, e.g., seat, the device 20 onto the post.

A loop or ring 42 of any suitable strong material, e.g., aluminum, is fixedly secured to the skirt portion 38 of the cup-shaped member 34 adjacent the bottom edge 44 thereof to provide the connection point for the lanyard 24. The ring 42 is secured in place by means of a thin strap 46 formed of the same material as that of the cup-shaped member. The midpoint 48 of the strap 46 is gathered and stitched by stitches 50 (FIG. 2) to form a reduced width portion which is extended through the hole 52 in the ring 42. The portions of the strap 46 on either side of its midpoint 48 are disposed along the bottom marginal edge of the skirt for the width of the web of material forming the cup-shaped member 34 and are secured in place by plural stitch lines 54. This arrangement mounts the ring 42 so that it is oriented generally perpendicularly to the surface of the cup shaped member 34, but is free to pivot slightly about the midpoint 48 of the strip 46. Accordingly, the ring 42 is readily accessible to have a clip or carabiner 56 (FIG. 4) at the free end of the worker's lanyard 24 releasably secured thereto.

In order to protect the cup-shaped member 34 from wear in when it is in place on the scaffold post 22 the inner surface 56 (FIG. 2) of the top portion 36 of that member includes a reinforcing material patch 58 secured thereto. The reinforcing patch 58 is formed of a any suitable material, e.g., leather, nylon, polyethylene, etc., of either single or multiple thicknesses, and is secured in place by plural lines of stitches 60 so that it will engage the free end 26 of scaffold post 22 when that end is located within the hollow interior 40 of the cup-shaped member 34.

With the device 20 in place on the scaffold post, the reinforcing patch rests on the top free end of the post while the downwardly depending skirt portion 36 is disposed about the periphery of the post below the top free end. This arrangement ensures that the device stays in place against accidental disconnection. Removal of the device from the post can be readily accomplished by merely lifting it upward off of the post until the free end of the post clears the bottom marginal edge 44 of the device.

In accordance with one preferred method of use, the lanyard worn by the worker is a doubled headed lanyard, such as that disclosed in my U.S. Pat. No. 5,287,943, entitled Dual Connection Lanyard For Use In A Safety System, whose disclosure is incorporated by reference herein. That lanyard is a generally Y-shaped member having a common leg which is arranged to be attached to a safety belt or harness, and a pair of legs connected to the common leg. Each of the legs of the pair of legs has a carabiner or clip 56 at the end thereof for securement to any anchor point. When used with the subject invention either of the lanyard's legs can be releasably secured to the ring 56 of any device 20, when that device is mounted on the scaffold post, as described above, to thereby protect the worker from falling off of the scaffold. In particular, when using the aforementioned lanyard one of its legs is connected by its carabiner 56 to a device 20 mounted on a scaffold post 22 adjacent the location at which the worker will be working, leaving the other leg of the lanyard free. Once this connection has been accomplished the worker is protected from falling. When the worker desires to move to another location, e.g., an adjacent position, while being protected from a fall during the move, all that is required is for the worker to connect the carabiner on the free end of the other leg of his/her lanyard to the device 20 which is mounted on the scaffold post adjacent the desired new position. Once this has been accomplished the worker can then disconnect the leg of his/her lanyard from the device to which it had been connected.

Figure 5:
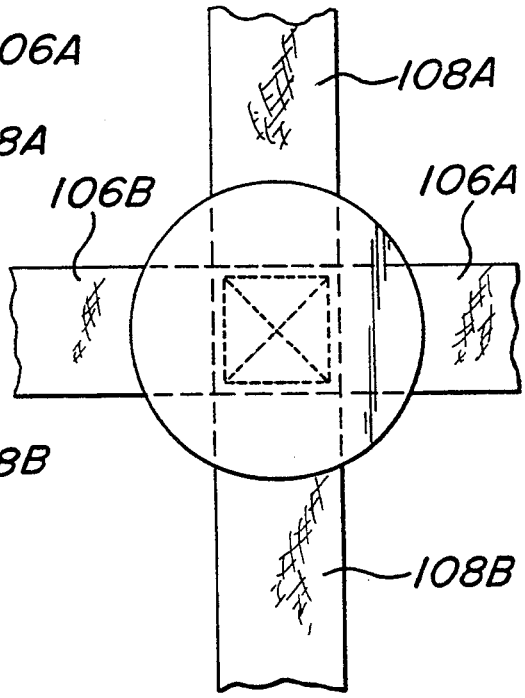
FIG. 5 is a reduced plan view showing a portion of the device of FIG. 4 during the construction thereof.
Figure 6:
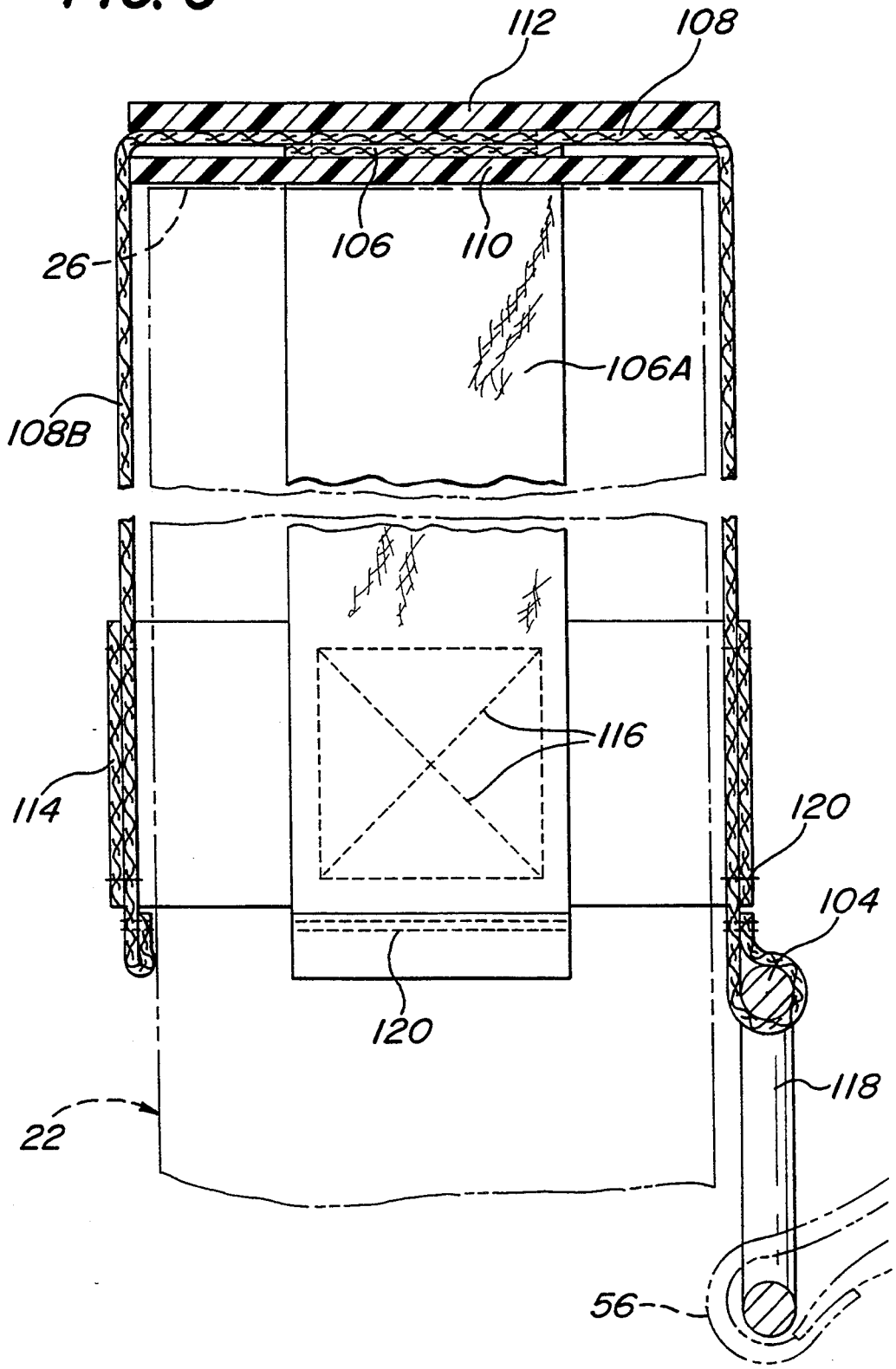
FIG. 6 is an enlarged sectional view taken along line 6—6 of FIG. 4.

In FIGS. 4–6 the embodiment 100 is shown. That device also is in the form of a hollow cup-shaped member 102 having a carabiner connecting ring 104 secured thereto. The cup-shaped member 102 is formed of a pair of flat strips 106 and 108, a pair of circular disks 110 and 112 and an annular band 114. The strips 106 and 108 are each formed of a flexible material, like that used to make the member 34 described heretofore, and are disposed perpendicular to each other and secured together by plural stitch lines 114 at their intersection. The intersection point of the strips is disposed or sandwiched between the pair of circular disks 110 and 112 and the disks are fixedly secured thereto by any suitable means, e.g., the stitch lines 114. Alternatively, or in addition, an adhesive (not shown) may be used. The disks can be formed of any strong reinforcing material, e.g., leather, plastic, nylon, etc.

The strips 106 and 108 are bent downward from the disks to form strip portions 106A and 106B of strip 106 and strip portions 108A and 108B of strip 108. The respective longitudinal axes of those strip portions are parallel to one another and the strips portions are equidistantly spaced from one another. The lower ends the strip portions 106A, 106B, 108A, and 108B are fixedly secured together by the annular band 114. In particular, the lower end of each of the strip portions is secured by plural stitch lines 116. The resulting construction produces a cup shaped member 102 having a top wall portion (formed by the disks 110 and 112) and a downwardly depending skirt portion (formed by the strip portions 106A, 106B, 108A, and 108B). The hollow interior of the cup shaped member 102 is designated by the reference number 118 and serves to receive the top free end of the scaffold post 22 in a similar manner as described with reference to device 20. With the device 100 mounted on the scaffold post the disk 110 will be seated on the top free end 26 to thereby protect the strips from wear.

The carabiner connecting ring 104 is secured to the lower end of the strip portion 108A of the cup shaped member 102, by extending that end of the strip through the hole 118 in the ring and folding that end back over itself and sewing it together by stitch lines 120. This arrangement enable the ring 104 to pivot with respect to the cup shaped member 102.

As should be appreciated by those skilled in the art use the devices 20 and 100 provides fall protection to workers without having to unnecessarily shortening the lanyard length, thereby giving the worker maximum freedom of movement. Moreover, the pivotable connection between the carabiner-connecting ring and the cup shaped member ensures that freedom of movement isn't compromised. Further, since plural devices 20/100 may be located at closely spaced scaffold posts all over the scaffold, with the connection to the scaffold at approximately shoulder height, the worker is protected from a fall irrespective of where he/she is located, and even if the worker does fall off of the scaffold he/she will not drop far and thus, should not sustain any injury causing shock.

Without further elaboration the foregoing will so fully illustrate my invention that others may, by applying current or future knowledge, adapt the same for use under various conditions of service.

I claim:

1. A device for releasable securement to an upwardly extending section of a scaffold on which a worker wearing a safety restraint member will be disposed, with the scaffold section terminating in a free, top end, said device comprising a hollow cup-shaped connector member having a ring secured thereto, said cup-shaped connector member being formed of a flexible material and having a top portion including an inner surface and a downwardly depending skirt portion forming a hollow interior, said device being arranged to be located on the scaffold by inserting the free end of the scaffold section within said hollow interior of said cup-shaped connector member, said inner surface of said top portion of said cup-shaped member being formed of a reinforcing material for engagement with the free end of the upwardly extending section of the scaffold when that section is disposed within said hollow interior to prevent erosion of the material forming said cup-shaped member, said downwardly depending skirt being disposed adjacent the outer surface of the scaffold section contiguous with the top free end thereof and including a bottom marginal edge portion extending about the periphery of said outer surface of said scaffold section to retain said device in place on said scaffold section, said ring being secured to said bottom marginal edge portion and being arranged to have the safety restraint member releasably secured thereto to thereby prevent the worker from falling off of the scaffold.

2. The connector of claim 1 wherein said cup-like member is formed of a fabric

3. The connector assembly of claim 2 wherein said fabric is nylon or polyester.

4. The connector assembly of claim 1 wherein said ring is pivotally connected to said bottom marginal edge portion.

5. The connector assembly of claim 2 wherein said ring is pivotally connected to said bottom marginal edge portion.

* * * * *